US005282337A

United States Patent [19]

Duhame et al.

[11] Patent Number: 5,282,337

[45] Date of Patent: Feb. 1, 1994

[54] GARAGE DOOR OPERATOR WITH PEDESTRIAN LIGHT CONTROL

[75] Inventors: Dean C. Duhame, Roseville; Daniel V. Meyvis, Bloomfield Hills, both of Mich.

[73] Assignee: Stanley Home Automation, Novi, Mich.

[21] Appl. No.: 20,383

[22] Filed: Feb. 22, 1993

[51] Int. Cl.[5] ..... E05F 11/00

[52] U.S. Cl. ..... 49/199; 49/70; 49/360; 160/188

[58] Field of Search ..... 49/199, 200, 70, 360, 49/362; 160/188, 189

[56] References Cited

U.S. PATENT DOCUMENTS 4,344,252 8/1982 Suzuki et al. ..... 49/199

4,885,872 12/1989 Chang et al. ..... 49/200 X

*Primary Examiner*—Philip C. Kannan

*Attorney, Agent, or Firm*—Krass & Young

[57] ABSTRACT

A garage door operator has a light which is turned on for a preset period by the controller each time the operator motor is operated. A pedestrian door is equipped with a magnetic switch which signals the controller when the door is opened, causing the light to be turned on for the preset period. A switch console has a vacation switch, a work light switch and a push button which, with the magnetic switch, send signals to the controller. Voltage level encoding and decoding is used to minimize the number of connecting wires between the console and the controller. The controller comprises a microprocessor subject to the switch inputs and programmed to produce output signals for operator motor control and light control.

7 Claims, 2 Drawing Sheets

GARAGE DOOR OPERATOR WITH PEDESTRIAN LIGHT CONTROL

FIELD OF THE INVENTION

This invention relates to garage door operating systems having a garage light and particularly to the control of such a garage light by a door operator and by a pedestrian door.

BACKGROUND OF THE INVENTION

Garage door operators responsive to manually controlled switches directly wired to the controller or coupled by radio signals to the controller are well known. The controller normally opens a door if it is closed when the switch is actuated and closes the door if it is open when the switch is actuated. Usually such operators are equipped with a lamp which illuminates the garage each time the operator is actuated and a time delay keeps the lamp on for a few minutes after actuation. It is also known to provide a work light switch to turn on the lamp and to turn it off when desired. A switch console on the garage wall houses the work light switch and the push button for door actuation. In some cases a vacation switch is included in the console for disabling all operator functions as long as the switch is closed; this is typically used to prevent door operation when the user is away for an extended period.

While such garage door operators are able to illuminate the garage upon manual switch operation, a person entering a dark garage through the pedestrian door from the house or from outside will have to locate and operate the work light switch to obtain light and again operate the switch when leaving the garage to turn out the light. It is thus desirable to have a light turn on when the pedestrian door is opened and to later turn off without user action. Thus it is proposed here that a desirable additional function of a garage door operator is to illuminate the lamp whenever the pedestrian door is opened to allow immediate vision by a user upon entering an otherwise dark garage and to automatically turn off the lamp.

SUMMARY OF THE INVENTION

It is therefore an object of the invention to improve on garage door operators by including a garage illumination feature which turns on the operator lamp when a pedestrian door is opened and automatically turns off. Another object is to employ the customary light time delay feature of the garage door operator to turn off the lamp.

The invention is carried out in a garage door operator having a control for turning on the operator lamp for a predetermined time delay by a door switch attached to the pedestrian door for detecting when the door is opened, which switch activates the control to turn on the operator lamp and initiate a predetermined time delay. When the delay times out, the lamp is turned off.

Special features are included to facilitate installation and usage of the pedestrian door controlled light. When the operator system is equipped with a switch console wired to the operator, the pedestrian door switch is wired to the console. To allow another signal to be sent to the operator via the existing wires, a simple form of multiplexing is used. In particular, the door switch signal is encoded, along with another parameter such as the work light switch signal, and sent to the operator where it is decoded and acted upon. The encoding employs generating different voltages for different switch functions, and decoding comprises sensing the transmitted voltage level to determine which switch function is commanded.

Another feature is to combine the pedestrian door controlled light with the known work light switch on the switch console so that the same lamp is used for both functions although no time delay is used with the work light switch.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

The ensuing description is directed to a garage door operator coupled to a pedestrian door operated switch wherein the operator has a lamp or light which is turned on by the door operated switch. The operator opens and closes the vehicle or main garage door according to well known control principles which are not repeated herein and may include a remote controller coupled by a radio signal to the operator. The specifics of the control are not important here except that the operator turns on the light each time the vehicle door is operated and turns off the light after a predetermined time delay. The pedestrian door is the service or entry door for human entry to the garage and usually is the passage to a house or to the outside. Opening of the pedestrian door is detected by a magnetic switch. Other types of switches or sensors may be used to detect the door opening.

Figures 1, 2:
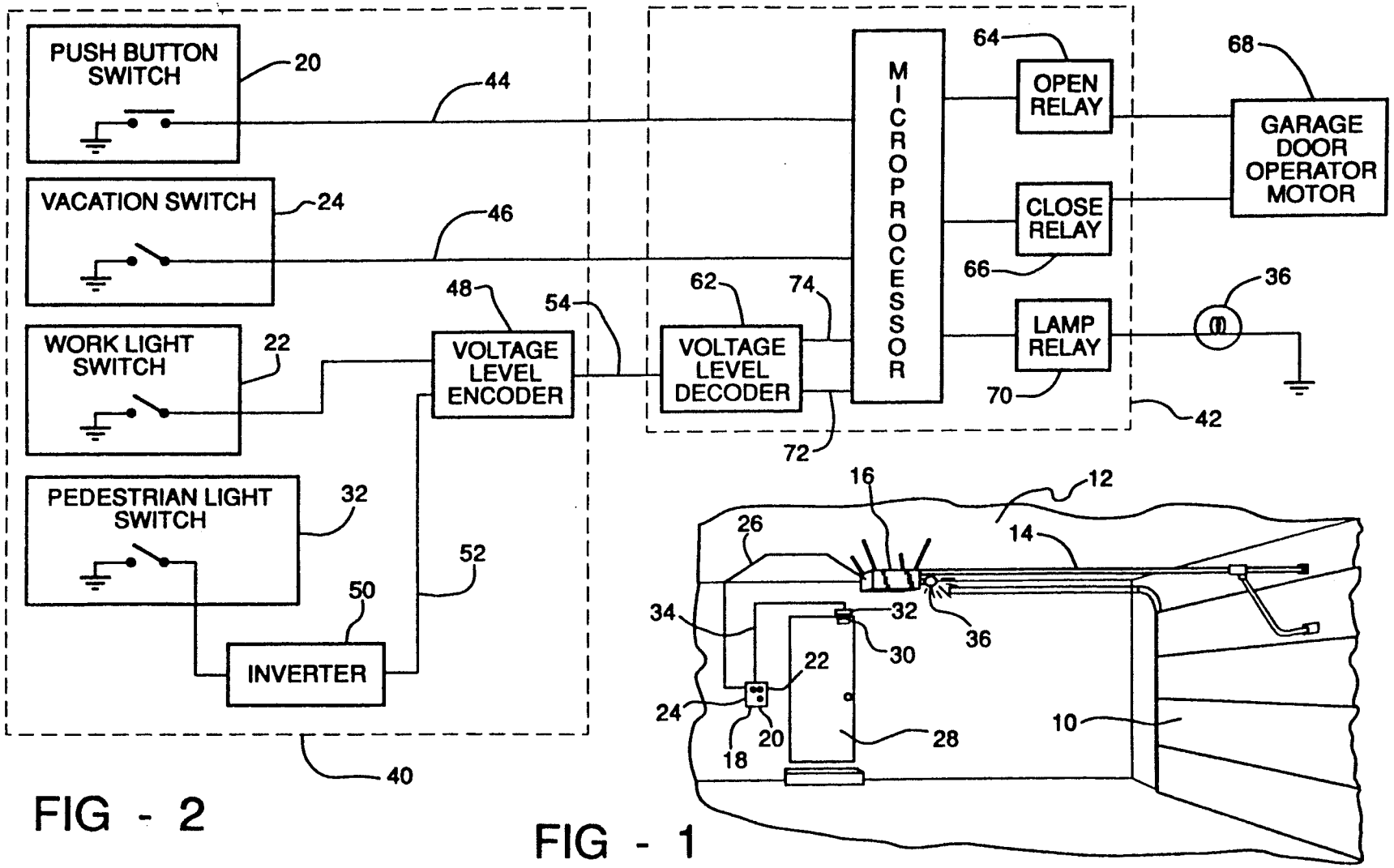
FIG. 1 is a perspective view of a garage having vehicle and pedestrian doors and a door operator according to the invention.
FIG. 2 is a block diagram of the garage door operator and input switches of FIG. 1, according to the invention.

In FIG. 1 a garage door 10 is opened and closed by a door operator 12 which includes a center rail 14 and a controller 16 mounted above the path of door movement. A wall mounted switch console 18 includes a push button 20 for door operation, a work light switch 22 for full time light operation when the switch is closed, and a vacation switch 24 for disabling the operator functions. The console 18 is connected by wiring 26 to the operator controller 16. A pedestrian door 28 carries a magnet 30 adjacent its upper edge and a magnetic switch 32 is mounted on the wall or door jamb adjacent the magnet 30. Switch wires 34 run between the magnetic switch 32 and the switch console 18. A lamp 36 is mounted on the controller 16 for operation by the controller.

FIG. 2 shows the door operator system divided into a switch section 40 and an output section 42. The switch section 40 includes the console 18 functions and the magnetic switch 32 or pedestrian light switch. The push button switch 20 is a normally open switch coupled between ground and an output line 44 to send a momentary ground signal to the output section 42 lasting only while the button is depressed. The vacation switch 24 is a two position toggle switch which is manually placed in either position and is connected between ground and output line 46. For vacation mode the switch is closed to ground the line 46. The work light switch 22 is a two position toggle switch connected between ground and a voltage level encoder 48. The switch is closed to turn on the work light. The pedestrian light switch or magnetic switch 32 is normally closed when the door 28 is closed and open when the door is open. The switch 32 is coupled to an inverter 50 which produces a ground signal on line 52 when the door is open so that, as in the case of the work light switch, the beginning of a ground signal dictates that the light be turned on. The line 52 is connected to the voltage level encoder 48 which produces an output voltage on line 54 according to whether work light switch is closed, the pedestrian door is open, or neither. For example, when the work light switch is closed, the voltage on line 54 is at ground level, and the state of the door switch has no effect. When the door is open and switch 22 is open, the voltage may be 2 volts; and when the door is closed and the switch 22 is open, the voltage may be 5 volts. Thus by combining the information on two switch states for transmission over one line 54, the expense of additional transmission lines is avoided.

The output section 42 is a microprocessor based controller having a microprocessor 60, a voltage level decoder 62, open and close relays 64 and 66 at processor output terminals to control the garage door operator motor 68, and a lamp relay 70 to control the lamp 36. The voltage level decoder 62 energizes input lines 72 and 74 to the microprocessor 60 according to the output level of the encoder 48. The decoder 62, may be, for example, a comparator circuit biased to distinguish the various input voltage levels. Alternatively, the decoding function can be carried out within the microprocessor. The line 44 and 46 from the push button switch and the vacation switch also are inputs to the microprocessor. The microprocessor is programmed to determine the appropriate motor and light operation based on the inputs, and also includes timing for the light control.

Figure 3:
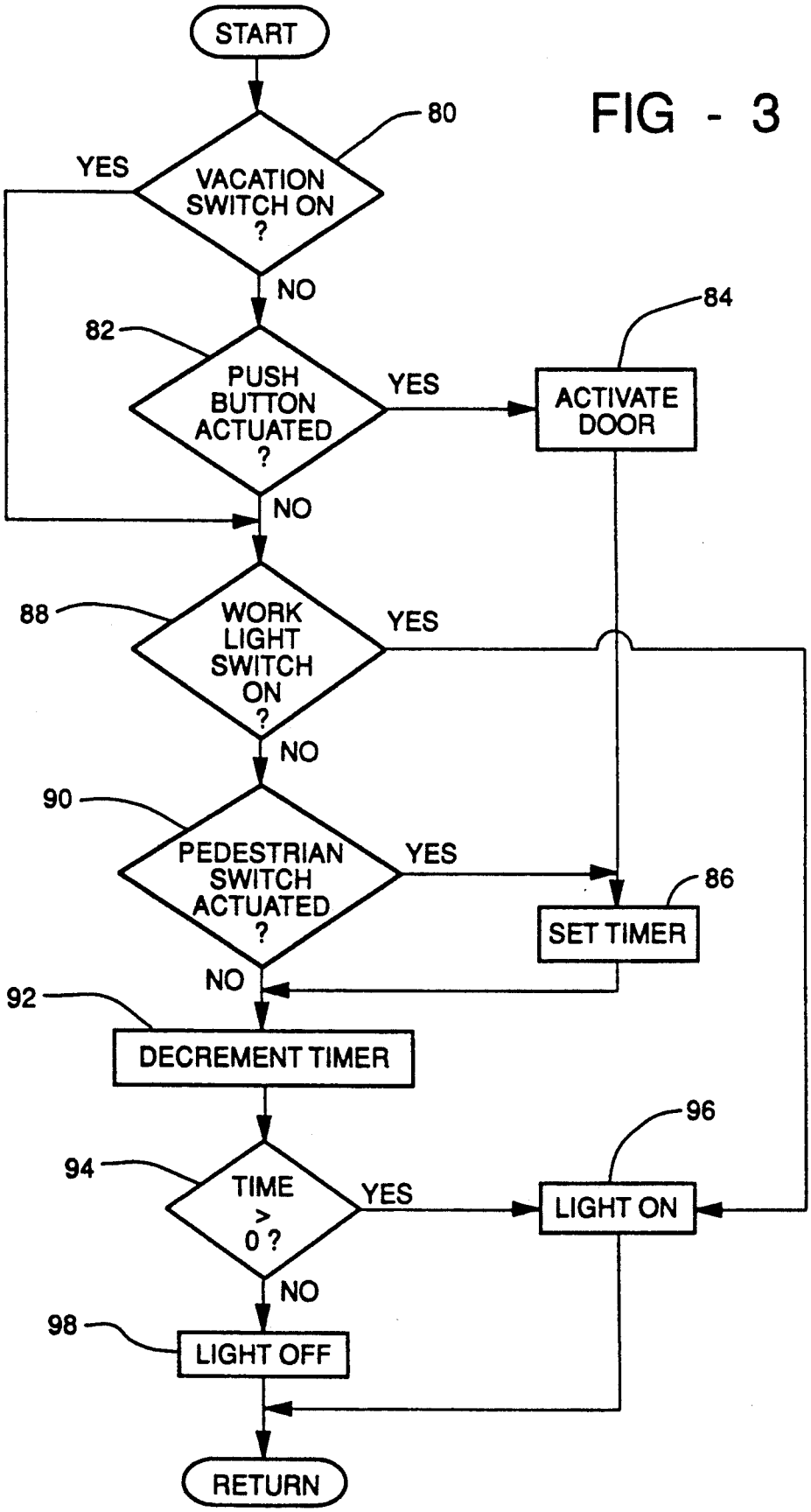
FIG. 3 is a flow chart illustrating the control logic of the microprocessor of the operator of FIG. 2.

FIG. 3 is a flow chart depicting the logic used for the microprocessor. The flow chart does not represent the actual program but is indicative of the logic used to control the light and to recognize the push button 20 operation. Block 80 determines whether the vacation switch 24 is on; if it is, the remainder of the program is bypassed and the program returns to start, and repeats until the vacation switch is turned off. Block 82 determines whether the push button 20 is actuated, and if it is the program initiates the door activation program 84. The routine of block 82 looks for a change of state of the push button switch 20 so that its actuation is detected only when the switch is initially closed. The door activation program is not shown since such programs are well known and depend on door position inputs not shown here. Then a light timer is set at block 86 to a value of, say, 4.5 minutes. If the push button is not newly actuated, but the work light switch is on, as determined at block 88, the timer is also set at block 86. Here the block 80 routine looks at the continuing state of the switch 22, so that each time through the program the timer is again set to the predetermined value and does not time out while the work light switch is actuated. If the work light switch is off, the block 90 determines whether the pedestrian door switch 32 is newly actuated, and if so the timer is set at block 86. Then, for each pass through the routine the timer is decremented at block 92. If then, the time remaining on the timer is greater than zero (block 94), the light relay 70 is turned on or remains on (block 96), or if the time is not greater than zero, the light relay is turned off (block 98).

It will thus be seen that the same timer arrangement is used to turn on the light for a time for the case where the: push button 20 is actuated to activate the door motor and where the pedestrian door switch 32 is actuated.

The embodiments of the invention in which an exclusive property or privilege is claimed are defined as follows:

1. A garage door opener system including apparatus for operating a garage door and for illuminating the garage when the garage door is operated or a pedestrian door is opened, comprising:

means responsive to a push button for producing a first signal for actuating the garage door;

means responsive to opening the pedestrian door for producing a second signal;

a light circuit having a light and means for illuminating the light including time delay means for holding the light on for a period; and means responsive to either of the first or the second signal for activating the light circuit, whereby the light is illuminated for the time delay period following opening of the pedestrian door or activation of the push button.

2. The invention as defined in claim 1 wherein the system includes:

a work light switch for producing a third signal: and means independent of the time delay means and responsive to the third signal for activating the light circuit as long as the third signal is present.

3. The invention as defined in claim 1 wherein the means for producing a second signal comprises a door-operated switch.

4. A garage door opener system including apparatus for operating a garage door and for illuminating the garage when the garage door is operated or a pedestrian door is opened, comprising:

a light;

a garage door operator for opening and closing the garage door;

a switch input section comprising a first switch for producing a garage door activation signal and a second switch for producing a pedestrian door open signal, the second switch being actuated upon opening of the pedestrian door; and an output section including a microprocessor based control responsive to the switch input section and coupled to the light and to the garage door operator for actuation thereof, the control including;

a time delay initiated by either of the door activation signal and the pedestrian door open signal for illuminating the light during the period of the time delay; and a door operation control initiated by the door activation signal for actuating the garage door operator.

5. The invention as defined in claim 4 wherein the switch section includes a third switch for producing a work light signal; and the output section includes a control for illuminating the light as long as the third switch is actuated.

6. The invention as defined in claim 5 wherein the input section includes means for encoding at least the pedestrian door open signal and the work light signal; and the output section includes means for decoding the signals.

7. The invention as defined in claim 5 wherein the input section includes means for encoding at least the pedestrian door open signal and the work light signal by producing a different voltage level for each signal; and the output section includes means for decoding the signals by detecting the voltage level.

* * * * *